US012352509B2

(12) United States Patent
Gao

(10) Patent No.: US 12,352,509 B2
(45) Date of Patent: Jul. 8, 2025

(54) MICROCHANNEL HEAT EXCHANGER

(71) Applicant: Johnson Controls Tyco IP Holdings LLP, Milwaukee, WI (US)

(72) Inventor: Xingshun Gao, York, PA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 18/028,181

(22) PCT Filed: Sep. 24, 2021

(86) PCT No.: PCT/US2021/051991

§ 371 (c)(1),
(2) Date: Mar. 23, 2023

(87) PCT Pub. No.: WO2022/067065

PCT Pub. Date: Mar. 31, 2022

(65) Prior Publication Data

US 2024/0318919 A1 Sep. 26, 2024

Related U.S. Application Data

(60) Provisional application No. 63/082,905, filed on Sep. 24, 2020.

(51) Int. Cl.
*F28F 9/02* (2006.01)
*F28D 7/16* (2006.01)

(52) U.S. Cl.
CPC ..... *F28D 7/163* (2013.01)

(58) Field of Classification Search
CPC ..... F28D 7/163
USPC ..... 165/175
See application file for complete search history.

(56) References Cited

U.S. PATENT DOCUMENTS

2013/0292098 A1 11/2013 Jindou et al.
2020/0256626 A1 8/2020 Nakamura et al.

FOREIGN PATENT DOCUMENTS

CN 101405559 B * 3/2013
CN 203980989 U 12/2014
CN 208536331 U * 2/2019
JP 2008002746 A 1/2008
KR 10-1910489 B1 10/2018

OTHER PUBLICATIONS

International Search Report and Written Opinion for PCT Application No. PCT/US2021/051991, mailed Jan. 3, 2022, 12 pages.

* cited by examiner

*Primary Examiner* — Davis D Hwu
(74) *Attorney, Agent, or Firm* — Fletcher Yoder, P.C.

(57) ABSTRACT

A heat exchanger for a heating, ventilation, and/or air conditioning (HVAC) system includes a header having a longitudinal axis, a first plurality of microchannel tubes coupled to the header, where each microchannel tube of the first plurality of microchannel tubes has a first width, and a second plurality of microchannel tubes coupled to the header, where each microchannel tube of the second plurality of microchannel tubes has a second width greater than the first width.

19 Claims, 3 Drawing Sheets

MICROCHANNEL HEAT EXCHANGER

CROSS REFERENCE TO RELATED APPLICATION

This application is a U.S. National Stage Application of PCT International Application No. PCT/US2021/051991, entitled "MICROCHANNEL HEAT EXCHANGER," filed Sep. 24, 2021, which claims priority to and the benefit of U.S. Provisional Application No. 63/082,905, entitled "MICROCHANNEL HEAT EXCHANGER," filed Sep. 24, 2020, each of which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be noted that these statements are to be read in this light and not as admissions of prior art.

Chiller systems, or vapor compression systems, utilize a working fluid (e.g., a refrigerant) that changes phases between vapor, liquid, and combinations thereof, in response to exposure to different temperatures and pressures within components of the chiller system. The chiller system may place the working fluid in a heat exchange relationship with a conditioning fluid (e.g., water) and may deliver the conditioning fluid to conditioning equipment and/or a conditioned environment serviced by the chiller system. In such applications, the conditioning fluid may be passed through downstream equipment, such as air handlers or terminal units, to condition other fluids, such as air in a building.

In typical chillers, the conditioning fluid is cooled by an evaporator within which the working fluid absorbs heat from the conditioning fluid, thereby evaporating the working fluid. The working fluid is then compressed by a compressor and transferred to a condenser. In the condenser, the working fluid is cooled, typically by a water or air flow, and condensed into a liquid. Air-cooled condensers typically include a condenser coil and a fan that forces an air flow over the condenser coil. Evaporators and condensers may have any of a variety of configurations, such as a shell and tube configuration, a tube and fin configuration, and so forth. In some embodiments, the tubes of the evaporator and/or condenser may be microchannel tubes, where each microchannel tube includes a plurality of flow paths formed therein that are configured to direct the working fluid therethrough. Unfortunately, heat exchangers having microchannel tubes may be susceptible to inducing undesirable pressure drops in the working fluid flowing therethrough, which may limit or otherwise affect the performance of the chiller system.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heat exchanger for a heating, ventilation, and/or air conditioning (HVAC) system includes a header having a longitudinal axis, a first plurality of microchannel tubes coupled to the header, where each microchannel tube of the first plurality of microchannel tubes has a first width, and a second plurality of microchannel tubes coupled to the header, where each microchannel tube of the second plurality of microchannel tubes has a second width greater than the first width.

In another embodiment, a heat exchanger for a heating, ventilation, and/or air conditioning (HVAC) system includes a header having a longitudinal axis, a first plurality of microchannel tubes coupled to the header and configured to direct a flow of working fluid therethrough, where each microchannel tube of the first plurality of microchannel tubes has a first width extending at a first angle relative to the longitudinal axis, and a second plurality of microchannel tubes coupled to the header and configured to direct the flow of working fluid therethrough, where each microchannel tube of the second plurality of microchannel tubes has a second width extending at a second angle relative to the longitudinal axis, and where the first angle and the second angle are different from one another.

In a further embodiment, a heat exchanger for a heating, ventilating, and/or air conditioning (HVAC) system includes a header having a longitudinal axis, a first plurality of microchannel tubes coupled to the header and configured to direct a flow of working fluid therethrough, where each microchannel tube of the first plurality of microchannel tubes has a first width extending at a first angle relative to the longitudinal axis, and a second plurality of microchannel tubes coupled to the header and configured to direct the flow of working fluid therethrough, where each microchannel tube of the second plurality of microchannel tubes has a second width extending at a second angle relative to the longitudinal axis, the second width is greater than the first width, and the first angle and the second angle are different from one another.

DRAWINGS

Various aspects of this disclosure may be better understood upon reading the following detailed description and upon reference to the drawings in which.

DETAILED DESCRIPTION

Figure 1:
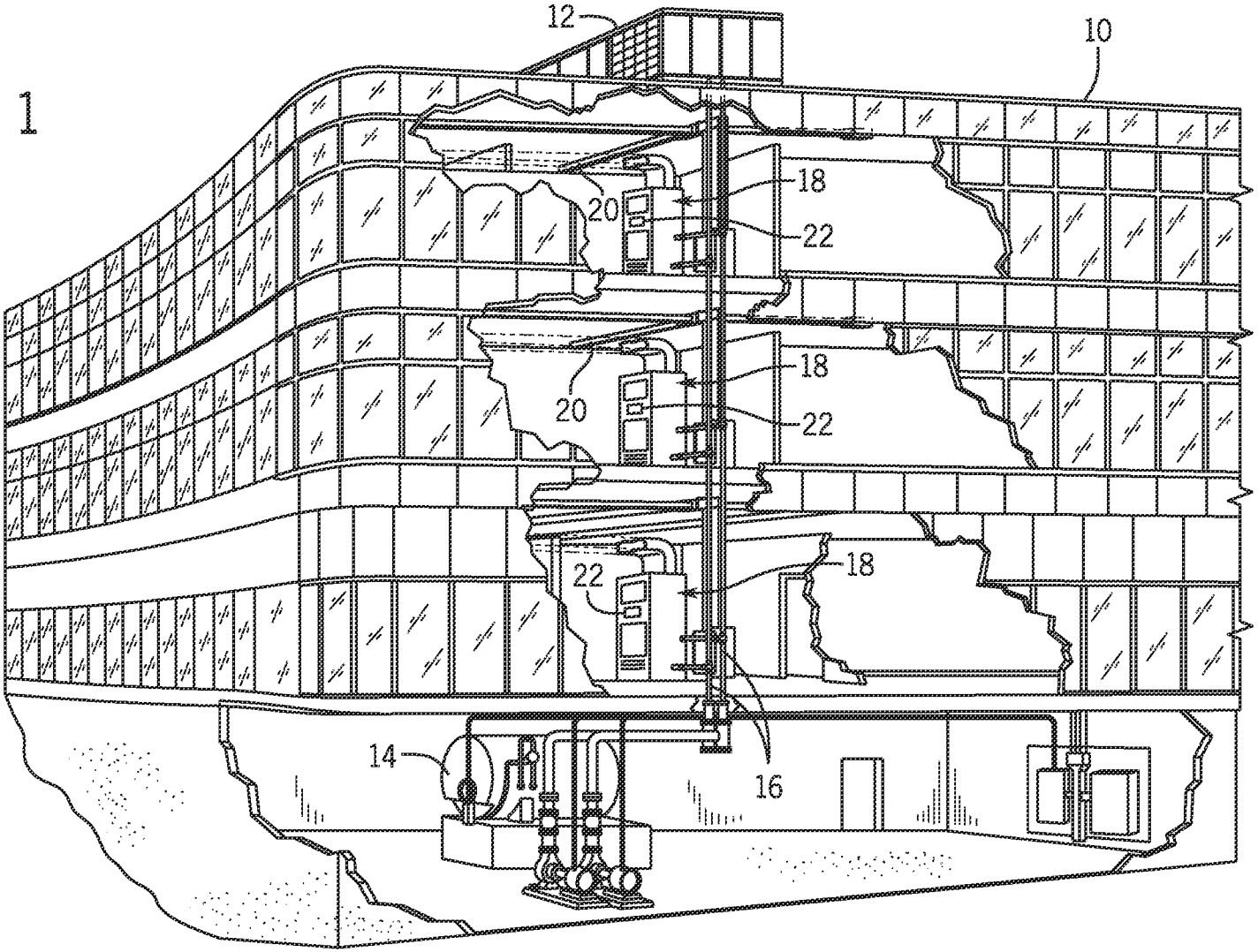
FIG. 1 is a perspective view of a building that may utilize an embodiment of a heating, ventilation, and air conditioning (HVAC) system in a commercial setting, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

Embodiments of the present disclosure relate to a heating, ventilation, and/or air conditioning (HVAC) system configured to cool a conditioning fluid. For example, the HVAC system may receive the conditioning fluid from a structure (e.g., a building) and may cool the conditioning fluid. The HVAC system may then return the cooled conditioning fluid to the structure for use in further conditioning (e.g., cooling, dehumidifying, etc.) another fluid, such as an air flow supplied to the structure. In certain embodiments, the HVAC system includes a vapor compression system (e.g., a refrigerant circuit) configured to cool a working fluid (e.g., a refrigerant) and to place the cooled working fluid in a heat exchange relationship with the conditioning fluid to absorb heat or thermal energy from the conditioning fluid and thereby cool the conditioning fluid. For example, an evaporator of the vapor compression system may place the cooled working fluid in a heat exchange relationship with the conditioning fluid to evaporate the working fluid and cool the conditioning fluid.

The vapor compression system may also include a condenser configured to place heated working fluid (e.g., refrigerant that has absorbed heat or thermal energy from the conditioning fluid) in a heat exchange relationship with a cooling fluid, such as an ambient air flow, in order to cool the working fluid for reuse in cooling the conditioning fluid in the evaporator. As will be appreciated, the evaporator and the condenser are each a heat exchanger configured to place two fluids (e.g., two of the working fluid, cooling fluid, and conditioning fluid) in a heat exchange relationship with one another to enable heat transfer therebetween. In some embodiments, the heat exchanger of the condenser and/or evaporator may be a microchannel heat exchanger having a plurality of microchannel tubes, where each microchannel tube has multiple flow paths configured to direct a fluid (e.g., the working fluid) therethrough. Unfortunately, working fluid flowing through a microchannel heat exchanger may be susceptible to undesirable pressure drops, which may adversely impact the performance of the vapor compression system.

It is presently recognized that there is a need to improve the operation of microchannel heat exchangers, such as by reducing a pressure drop of a working fluid directed therethrough. Accordingly, embodiments of the present disclosure are directed to a microchannel heat exchanger having a plurality of microchannel tubes, where at least two microchannel tubes have different dimensions. For example, in accordance with the presently disclosed techniques, different microchannel tubes within a common heat exchanger may have different tube widths or lateral dimensions, different flow path areas (e.g., cumulative cross-sectional area of the microchannels formed within the microchannel tube), or other dimensions different from that of another microchannel tube in the microchannel heat exchanger. In some embodiments, the microchannel tubes of a microchannel heat exchanger may be grouped or divided into a first subset of microchannel tubes and a second subset of microchannel tubes. For example, each microchannel tube of the first subset may have a first width or lateral dimension (e.g., a dimension crosswise to a direction of working fluid flow through the microchannels of the microchannel tube), and each microchannel tube of the second subset may have a second width or lateral dimension different from (e.g., greater than) the first width or lateral dimension. Each microchannel tube of the first subset and each microchannel tube of the second subset may nevertheless be coupled to one or more common headers of the microchannel heat exchanger to enable flow of the working fluid through each microchannel tube of the microchannel heat exchanger.

As discussed in further detail below, headers of the microchannel heat exchanger may be sized to accommodate a first subset of microchannel tubes having a first width arranged in a traditional orientation (e.g., generally perpendicular relative to a longitudinal axis of the headers, a horizontal orientation relative to a vertical orientation of the headers, etc.). In order to implement a second subset of microchannel tubes having a second width that is greater than the first width, the second subset of microchannel tubes may be fluidly coupled to the headers in an angled orientation, such as at an oblique angle (e.g., relative to the orientation of the first subset of microchannel tubes, relative to the longitudinal axis of the headers, etc.). In this way, the second subset of microchannel tubes may be larger (e.g., wider) than the microchannel tubes of the first subset. In other words, the second subset of microchannel tubes coupled to the headers at the above-described angle may be larger or wider than microchannel tubes coupled to the headers in a traditional orientation (e.g., in which a width of the microchannel tubes extends generally perpendicularly to a longitudinal axis of the headers).

The larger size of the second subset of microchannel tubes provides an increase in heat transfer surface area (e.g., between the working fluid and the cooling fluid) and/or an increase in cumulative flow path area of the second subset of microchannel tubes (e.g., by including larger microchannels and/or additional numbers of microchannels in each microchannel tube). As will be appreciated, the increased heat transfer surface area and/or the increase flow path area of the microchannels in the second subset of microchannel tubes may enable a reduced pressure drop of the working fluid flowing through the microchannel heat exchanger (e.g., through the second subset of microchannel tubes). Additionally, the oblique, angular orientation of the second subset of microchannel tubes enables the use of smaller headers with the microchannel heat exchanger, which reduces costs associated with manufacturing of the microchannel heat exchanger. In particular, the present techniques enable the use of headers designed (e.g., sized) for first microchannel tubes coupled to the header in a traditional (e.g., horizontal, generally perpendicular, etc.) configuration while also incorporating second microchannel tubes having greater widths or lateral dimensions than the first microchannel tubes. While the discussion below describes the present techniques in the context of a condenser, it should be appreciated that the present techniques may be implemented with any microchannel heat exchanger.

Turning now to the drawings, FIG. 1 is a perspective view of an embodiment of an application for a heating, ventilation, and/or air conditioning (HVAC) system. Such systems, in general, may be applied in a range of settings, both within the HVAC field and outside of that field. The HVAC systems may provide cooling to data centers, electrical devices, freezers, coolers, or other environments through vapor-compression refrigeration, absorption refrigeration, or thermoelectric cooling. In presently contemplated applications, however, HVAC systems may be used in residential, commercial, light industrial, industrial, and/or in any other application for heating or cooling a volume or enclosure, such as a residence, building, structure, and so forth. Moreover, the HVAC systems may be used in industrial applications, where appropriate, for basic cooling and heating of various fluids.

The illustrated embodiment shows an HVAC system for building environmental management that may utilize heat exchangers. A building 10 is cooled by a system that includes a chiller 12 and a boiler 14. As shown, the chiller 12 is disposed on the roof of building 10, and the boiler 14 is located in the basement; however, the chiller 12 and boiler 14 may be located in other equipment rooms or areas next to the building 10. The chiller 12 may be an air-cooled or water-cooled device that implements a refrigeration cycle to cool water or other conditioning fluid. The chiller 12 is housed within a structure that includes a refrigeration circuit, a free cooling system, and associated equipment such as pumps, valves, and piping. For example, the chiller 12 may be single packaged rooftop unit that incorporates a free cooling system. The boiler 14 is a closed vessel in which water is heated. The water from the chiller 12 and the boiler 14 is circulated through the building 10 by water conduits 16. The water conduits 16 are routed to air handlers 18 located on individual floors and within sections of the building 10.

The air handlers 18 are coupled to ductwork 20 that is adapted to distribute air between the air handlers 18 and may receive air from an outside intake (not shown). The air handlers 18 include heat exchangers that circulate cold water from the chiller 12 and hot water from the boiler 14 to provide heated or cooled air to conditioned spaces within the building 10. Fans within the air handlers 18 draw or force air across the heat exchangers to condition the air and direct the conditioned air to environments within building 10, such as rooms, apartments, or offices, to maintain the environments at a designated temperature. A control device, shown in the illustrated embodiment as including a thermostat 22, may be used to designate the temperature of the conditioned air. The control device 22 may also be used to control the flow of air through and from the air handlers 18. Other devices may be included in the system, such as control valves that regulate the flow of water and pressure and/or temperature transducers or switches that sense the temperatures and pressures of the water, the air, and so forth. Moreover, the control devices 22 may include computer systems that are integrated with or separate from other building control or monitoring systems, and even systems that are remote from the building 10.

Figure 2:
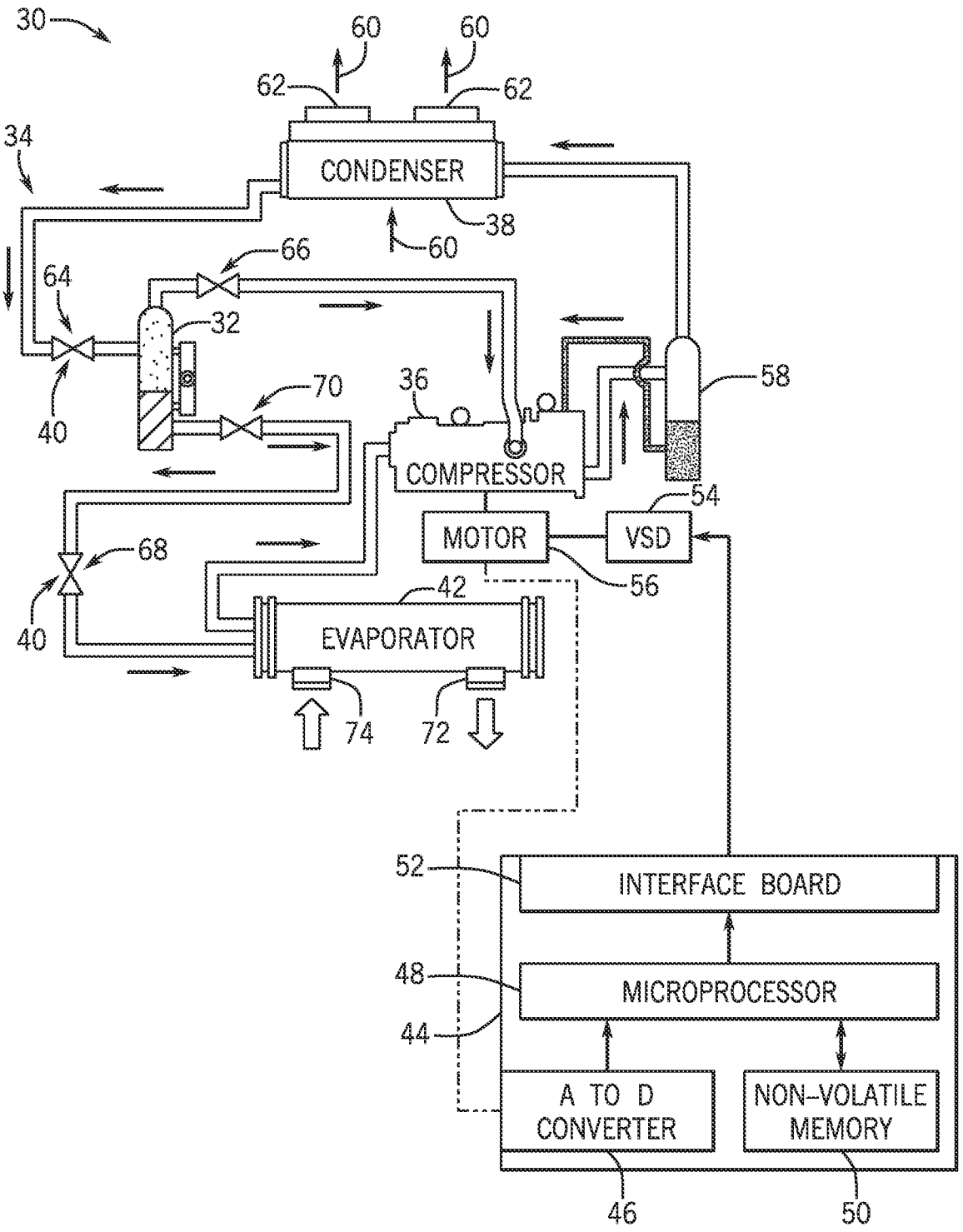
FIG. 2 is a schematic of an embodiment of a vapor compression system, in accordance with an aspect of the present disclosure.

FIG. 2 is a schematic of an embodiment of a vapor compression system 30 (e.g., an HVAC system) configured to utilize a working fluid, such as a refrigerant, to transfer thermal energy between various fluid flows, such as water and/or air. For example, the vapor compression system 30 may be a part of an air-cooled chiller (e.g., chiller 12). However, it should be appreciated that the disclosed techniques may be incorporated with a variety of other types of chillers, vapor compression systems, or other HVAC systems. The vapor compression system 30 includes a refrigerant circuit 34 configured to circulate a working fluid, such as refrigerant, therethrough with a compressor 36 (e.g., a screw compressor) disposed along the refrigerant circuit 34. The refrigerant circuit 34 also includes a flash tank 32, a condenser 38, expansion valves or devices 40, and a liquid chiller or evaporator 42. The components of the refrigerant circuit 34 enable heat transfer between the working fluid and other fluids (e.g., a conditioning fluid, a cooling fluid, air, water, etc.) in order to condition at least one of the fluids and provide conditioning to an environment, such as an interior of the building 10.

Some examples of working fluids that may be used as refrigerants in the vapor compression system 30 are hydrofluorocarbon (HFC) based refrigerants, for example, R-410A, R-407, R-134a, hydrofluoro-olefin (HFO), "natural" refrigerants like ammonia (NH3), R-717, carbon dioxide (CO2), R-744, or hydrocarbon-based refrigerants, water vapor, refrigerants with low global warming potential (GWP), or any other suitable refrigerant. In some embodiments, the vapor compression system 30 may be configured to efficiently utilize refrigerants having a normal boiling point of about 19 degrees Celsius (66 degrees Fahrenheit or less) at one atmosphere of pressure, also referred to as low pressure refrigerants, versus a medium pressure refrigerant, such as R-134a. As used herein, "normal boiling point" may refer to a boiling point temperature measured at one atmosphere of pressure.

The vapor compression system 30 may further include a control panel 44 (e.g., controller) that includes an analog to digital (A/D) converter 46, a microprocessor 48, a non-volatile memory 50, and/or an interface board 52. In some embodiments, the vapor compression system 30 may include one or more of a variable speed drive (VSD) 54 and a motor 56. The motor 56 may drive the compressor 36 and may be powered by the VSD 54. The VSD 54 is configured to receive alternating current (AC) power having a particular fixed line voltage and fixed line frequency from an AC power source and to provide power having a variable voltage and frequency to the motor 56 in order to drive operation of the compressor 36. In other embodiments, the motor 56 may be powered directly from an AC or direct current (DC) power source. The motor 56 may include any type of electric motor that can be powered by the VSD 54 or directly from an AC or DC power source, such as a switched reluctance motor, an induction motor, an electronically commutated permanent magnet motor, or another suitable motor.

The compressor 36 is configured to compress a refrigerant vapor within the refrigerant circuit 34 and deliver the compressed refrigerant vapor to an oil separator 58 configured to separate oil from the refrigerant vapor. The refrigerant vapor is then directed along the refrigerant circuit 34 toward the condenser 38, and the oil is returned to the compressor 36. The refrigerant vapor delivered to the condenser 38 may transfer heat to a cooling fluid at the condenser 38. For example, the cooling fluid may be ambient air 60 forced across heat exchanger coils of the condenser 38 by condenser fans 62. The refrigerant vapor within the heat exchanger coils may condense to a refrigerant liquid in the condenser 38 via thermal heat transfer with the cooling fluid (e.g., the ambient air 60).

The liquid refrigerant exits the condenser 38 and then continues flow along the refrigerant circuit 34 to a first expansion device 64 (e.g., expansion device 40, electronic expansion valve, etc.). The first expansion device 64 may be a flash tank feed valve configured to control flow of the liquid refrigerant to the flash tank 32. The first expansion device 64 is also configured to lower the pressure of (e.g., expand) the liquid refrigerant received from the condenser 38. During the expansion process, a portion of the liquid refrigerant may vaporize, and thus, the flash tank 32 may be used to separate the vapor refrigerant from the liquid refrigerant received from the first expansion device 64. Additionally, the flash tank 32 may provide for further expansion of the liquid refrigerant due to a pressure drop experienced by the liquid refrigerant when entering the flash tank 32 (e.g., due to a rapid increase in volume experienced by the liquid refrigerant when entering the flash tank 32).

The vapor refrigerant in the flash tank 32 may exit and flow along the refrigerant circuit 34 to the compressor 36. For example, the vapor refrigerant may be drawn to an intermediate stage or discharge stage of the compressor 36 (e.g., not the suction stage). A valve 66 (e.g., economizer valve, solenoid valve, etc.) may be included in the refrigerant circuit 34 to control flow of the vapor refrigerant from the flash tank 32 to the compressor 36. In some embodiments, when the valve 66 is open (e.g., fully open), additional liquid refrigerant within the flash tank 32 may vaporize and provide additional subcooling of the liquid refrigerant within the flash tank 32. The liquid refrigerant that collects in the flash tank 32 may be at a lower enthalpy than the liquid refrigerant exiting the condenser 38 due to the expansion of the liquid refrigerant at the first expansion device 64 and/or the flash tank 32. The liquid refrigerant may flow from the flash tank 32, through a second expansion device 68 (e.g., expansion device 40, an orifice, etc.), and to the evaporator 42. In some embodiments, the refrigerant circuit 34 may also include a valve 70 (e.g., drain valve) configured to regulate flow of liquid refrigerant from the flash tank 32 to the evaporator 42. For example, the valve 70 may be controlled (e.g., via the control panel 44) based on an amount of suction superheat of the liquid refrigerant.

The liquid refrigerant delivered to the evaporator 42 may absorb heat from a conditioning fluid, which may or may not be the same cooling fluid used in the condenser 38. The liquid refrigerant in the evaporator 42 may undergo a phase change to become vapor refrigerant. For example, the evaporator 42 may include a tube bundle fluidly coupled to a supply line 72 and a return line 74 that are connected to a cooling load (e.g., air handlers 18). The conditioning fluid (e.g., water, oil, calcium chloride brine, sodium chloride brine, or any other suitable fluid) enters the evaporator 42 via the return line 74 and exits the evaporator 42 the via supply line 72. The evaporator 42 may reduce the temperature of the conditioning fluid in the tube bundle via thermal heat transfer with the refrigerant so that the conditioning fluid may be utilized to provide cooling for a conditioned environment. The tube bundle in the evaporator 42 can include a plurality of tubes and/or a plurality of tube bundles. In any case, the refrigerant vapor exits the evaporator 42 and returns to the compressor 36 by a suction line to complete the refrigerant cycle.

As mentioned above, the vapor compression system 30 may include one or more microchannel heat exchangers. For example, the evaporator 42 and/or the condenser 38 may include one or more microchannel heat exchangers. As will be appreciated, microchannel heat exchangers include a plurality of microchannel tubes, where each microchannel tubes includes a plurality of flow paths (e.g., microchannels, working fluid flow paths, etc.) formed therein. As discussed in detail below, the present techniques are directed to microchannel heat exchangers having at least two microchannel tubes with different dimensions, such as different widths or lateral dimensions. Microchannel tubes having larger widths or lateral dimensions provide increased heat transfer surface area and/or an increased microchannel flow path area, which enables improved heat transfer between the working fluid and the conditioning fluid, as well as a reduction in working fluid pressure drop across the microchannel heat exchanger. The microchannel tubes having larger widths or lateral dimensions are fluidly coupled to headers of the microchannel heat exchanger at an angle (e.g., an oblique angle relative to a longitudinal axis of the headers) to enable reduced sizing of the headers and incorporation of the microchannel tubes with a greater width or lateral dimension. It should be appreciated that the techniques described herein may be incorporated with a microchannel heat exchanger for implementation in any suitable HVAC system, such as chillers, packaged units, split systems, and so forth.

Figure 3:
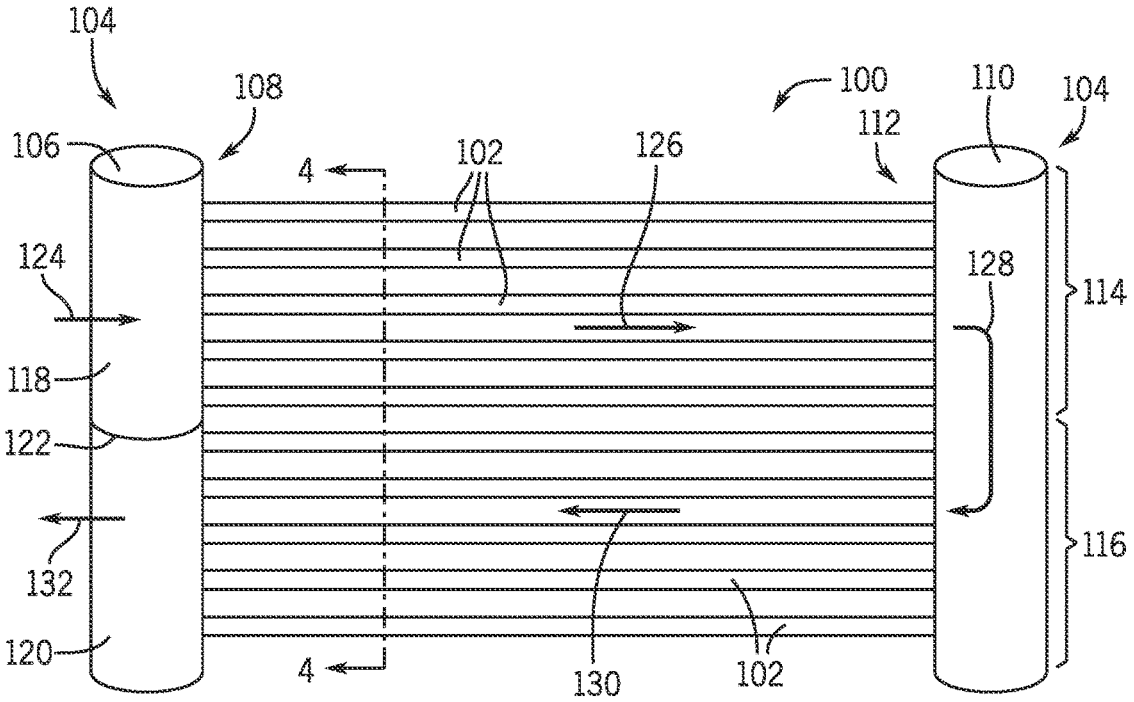
FIG. 3 is a schematic of a heat exchanger having a plurality of microchannel tubes, in accordance with an aspect of the present disclosure.

With this in mind, FIG. 3 is a schematic view of a microchannel heat exchanger 100 having a plurality of microchannel tubes 102 coupled to headers 104 of the microchannel heat exchanger 100. Specifically, a first header 106 is coupled to a first end 108 of each microchannel tube 102, and a second header 110 is coupled to a second end 112 of each microchannel tube 102. As will be appreciated, each microchannel tube 102 includes a plurality of channels or flow paths formed therethrough to direct a flow of working fluid between the first header 106 and the second header 108. In certain embodiments, the microchannel heat exchanger 100 may be utilized as the condenser 38 within the vapor compression system 30. For example, the microchannel heat exchanger 100 may be a component of the chiller 12 (e.g., an air-cooled chiller) and may be exposed to an ambient environment to enable heat exchange between refrigerant directed through the microchannel tubes 102 and an ambient air flow directed across the microchannel heat exchanger 100. In some embodiments, the microchannel heat exchanger 100 may be a heat exchanger slab of the condenser 38 and may be incorporated with one or more additional microchannel heat exchangers 100 of the condenser 38 (e.g., arranged in a V-shaped or W-shaped configuration).

In the illustrated embodiment, the microchannel heat exchanger 100 is a two-pass heat exchanger. To this end, the microchannel tubes 102 may be divided or grouped into a first subset 114 (e.g., a first plurality, a first pass, etc.) of microchannel tubes 102 and a second subset 116 (e.g., a second plurality, a second pass, etc.) of microchannel tubes 102. Further, the first header 106 is divided into a first section 118 and a second section 120 by a baffle 122 disposed within the first header 106. In operation, a working fluid (e.g., a vapor refrigerant discharged by the compressor 36) may enter the first section 118 of the first header 106, as indicated by arrow 124, and may subsequently flow into the first subset 114 of microchannel tubes 102. As indicated by arrow 126, the working fluid is directed through the first subset 114 of microchannel tubes 102 toward the second header 110. The working fluid then flows into the second header 110 from the first subset 114 of microchannel tubes 102, and the second header 110 directs the working fluid into the second subset 116 of microchannel tubes 102, as indicated by arrow 128. Thereafter, the working fluid is directed through the second subset 116 of microchannel tubes 102, as indicated by arrow 130, and into the second section 120 of the first header 106, from which the working fluid is discharged from the microchannel heat exchanger 100, as indicated by arrow 132, to continue flowing along the refrigerant circuit 34.

In some embodiments, the microchannel heat exchanger 100 may be configured to operate as a condenser, such as the condenser 38. Thus, the microchannel heat exchanger 100 may function to transfer heat from the working fluid to a cooling fluid directed across the microchannel heat exchanger 100, thereby cooling (e.g., condensing) the working fluid. In some embodiments, a first portion of the microchannel heat exchanger 100 may function to condense the working fluid, and a second portion of the microchannel heat exchanger 100 may function to subcool the working fluid (e.g., after the working fluid is condensed by the first portion of the microchannel heat exchanger 100). For example, the first portion may include the first subset 114 of microchannel tubes 102, which at least partially condenses the working fluid from a vapor to a liquid. The second portion may include the second subset 116 of microchannel tubes 102, which may function to at least partially subcool the working fluid (e.g., reduce a temperature of the working fluid beyond or lower the saturation temperature).

While the illustrated embodiment includes five microchannel tubes 102 in the first subset 114 and five microchannel tubes 102 in the second subset 116, it should be appreciated that other embodiments may have any suitable number of microchannel tubes in the first subset 114 and the second subset 116. As an example, the first subset 114 may include approximately 60 percent of a total number of the microchannel tubes 102 in the microchannel heat exchanger 100, and the second subset 116 may include approximately 40 percent of a total number of the microchannel tubes 102 in the microchannel heat exchanger 100. In another embodiment, the first subset 114 may include approximately two-thirds of a total number of the microchannel tubes 102 in the microchannel heat exchanger 100, and the second subset 116 may include approximately one-third of a total number of the microchannel tubes 102 in the microchannel heat exchanger 100. The respective numbers of microchannel tubes 102 included in the first subset 114 and the second subset 116 may depend on any of a variety of factors, such as an expected or predicted operating parameter of an air flow directed across the microchannel heat exchanger 100 (e.g., flow rate, temperature, etc.), an arrangement of the microchannel heat exchanger 100 within the vapor compression system 30 (e.g., as a portion or slab of a V-shaped condenser 38 configuration), an expected or predicted cooling load of the vapor compression system 30, another operating parameter of the microchannel heat exchanger 100 and/or vapor compression system 30, additional factors related to operation of the microchannel heat exchanger 100 and/or vapor compression system 30, or any combination thereof.

Figure 4:
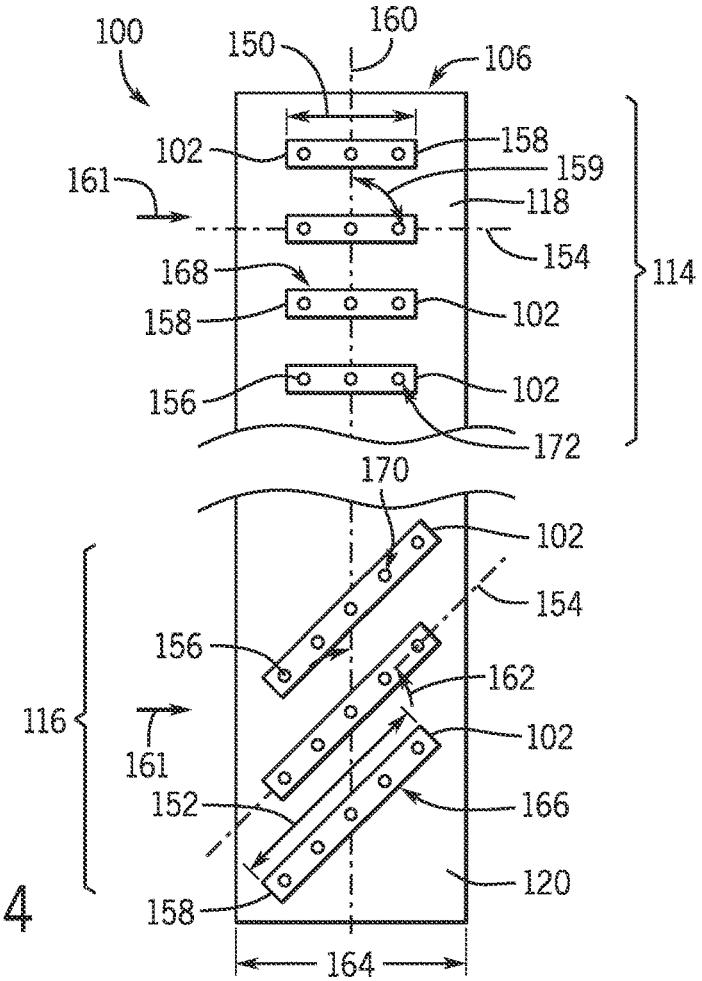
FIG. 4 is a schematic cross-sectional schematic of a heat exchanger having a plurality of microchannel tubes, in accordance with an aspect of the present disclosure.

As mentioned above, the microchannel heat exchanger 100 includes at least two microchannel tubes 102 having different dimensions (e.g., widths or lateral dimensions). For example, each microchannel tube 102 in the first subset 114 of microchannel tubes 102 may have a different width or lateral dimension than each microchannel tube 102 in the second subset 116 of microchannel tubes 102. To better illustrate, FIG. 4 is a cross-sectional view, taken along line 4-4 of FIG. 3, illustrating varying widths of the microchannel tubes 102 of the microchannel heat exchanger 100. Specifically, in the illustrated embodiment, each microchannel tube 102 of the first subset 114 of microchannel tubes 102 has a first width 150 or lateral dimension, and each microchannel tube 102 of the second subset 116 of microchannel tubes 102 has a second width 152 or lateral dimension greater than the first width 150 or lateral dimension.

As used herein, a "width" or "lateral dimension" of the microchannel tube 102 may refer to a dimension of the microchannel tube 102 along an axis 154 of the microchannel tube 102, where the axis 154 extends through each microchannel 156 (e.g., flow path) of the microchannel tube 102. That is, the axis 154 extends through and/or along the microchannel tube 102 in a direction in which the microchannels 156 are arrayed within the microchannel tube 102. In some embodiments, the width or lateral dimension may refer to a dimension of the microchannel tube 102 extending between sides or edges (e.g., lateral sides or edges) 158 of the microchannel tube 102, such as upstream and downstream edges (e.g., relative to a direction of air flow directed across the microchannel heat exchanger 100).

In the illustrated embodiment, each microchannel tube 102 in the first subset 114 is secured and fluidly coupled to the first header 106 (e.g., the first section 118), such that the first width 150 of each microchannel tube 102 extends generally perpendicularly (e.g., crosswise, at an angle 159, at an approximately ninety degree angle, etc.) to a longitudinal axis 160 of the first header 106. Thus, when the first header 106 is arranged in a generally vertical orientation, the first width 150 of each microchannel tube 102 extends in a generally horizontal orientation, as shown. The microchannel tubes 102 of the first subset 114 are may also be arranged to be generally aligned with a direction 161 of air flow across the microchannel heat exchanger 100. Each microchannel tube 102 in the first subset 114 may be similarly secured and fluidly coupled to the second header 110.

Each microchannel tube 102 in the second subset 116 is fluidly coupled to the first header 106 (e.g., the second section 120), such that the second width 152 of each microchannel tube 102 extends generally at an oblique (e.g., non-acute) angle 162 relative to the longitudinal axis 160 of the first header 106 and/or relative to the direction 161 of air flow across the microchannel heat exchanger 100. Each microchannel tube 102 in the second subset 116 may be similarly secured and fluidly coupled to the second header 110. The oblique angle 162 may be any suitable magnitude or value (e.g., 5, 10, 20, 30, 40, or 45 degrees) and may be selected based on a variety of factors, such as an expected or predicted operating parameter of an air flow directed across the microchannel heat exchanger 100 (e.g., flow rate, temperature, etc.), an arrangement of the microchannel heat exchanger 100 within the vapor compression system 30 (e.g., as a portion of a V-shaped condenser 38 configuration), an expected operating capacity or range of operating capacities of the microchannel heat exchanger 100 and/or the vapor compression system 30 having the microchannel heat exchanger 100, additional factors related to operation of the microchannel heat exchanger 100, or any combination thereof. In some embodiments, the microchannel tubes 102 of the second subset 116 may extend at different oblique angles 162 relative to the longitudinal axis 150 and relative to one another.

As will be appreciated, the microchannel tubes 102 of the second subset 116 may be coupled to the first header 106 at the oblique angle 162 relative to the longitudinal axis 160 in order to enable implementation of the microchannel tubes 102 having the second width 152 with the first header 106 having a smaller size. In other words, if the microchannel tubes 102 of the second subset 116 were instead oriented in a generally horizontal and/or perpendicular arrangement (e.g., similar to the arrangement of the first subset 114 of microchannel tubes 102), a larger size of the header 106 would be utilized with the microchannel heat exchanger 100. However, with the disclosed arrangement and orientation of the second subset 116 of microchannel tubes 102, the first header 106 may have a reduced size, thereby enabling a reduction in manufacturing costs associated with utilizing the microchannel tubes 102 having the second width 152. Indeed, in some embodiments, the second width 152 of the second subset 116 of microchannel tubes 102 may be greater than a diameter 164 of the first header 106, but the orientation of the second subset 116 of microchannel tubes 102 at the oblique angle 162 may enable the accommodation of the second width 152 with the diameter 161 of the first header 106.

Implementation of the microchannel tubes 102 having the second width 152 larger than the first width 150 of the first subset of microchannel tubes 102 enables several performance benefits for the microchannel heat exchanger 100 and the vapor compression system 30. For example, the increased second width 152 provides increased heat transfer surface area of the second subset 116 of microchannel tubes 102. In other words, an outer surface 166 of each microchannel tube 102 in the second subset 116 may have a greater area than an outer surface 168 of each microchannel tube 102 in the first subset 114 due to the second width 152 being greater than the first width 150. Similarly, heat exchanger fins coupled to the second subset 116 of microchannel tubes 102 may also have an increased size (e.g., increased width), as compared to heat exchanger fins coupled to the first subset 114 of microchannel tubes 102, which further enables an increase in heat transfer surface area. Thus, the heat transfer capacity of the microchannel heat exchanger 100 overall is increased.

Moreover, the second subset 116 of microchannel tubes 102 may be utilized in a portion of the microchannel heat exchanger 100 that is configured to subcool the working fluid directed through the microchannel heat exchanger 100, as discussed above. For example, the second subset 116 of microchannel tubes 102 may be disposed downstream of the first subset 114 of microchannel tubes 102 relative to a flow path of the working fluid through the microchannel heat exchanger 100. That is, working fluid flowing through the microchannel heat exchanger 100 may first flow through the first subset 114 of microchannel tubes 102 (e.g., to condense the working fluid) and subsequently flow through the second subset 116 of microchannel tubes 102 (e.g., to subcool the working fluid). The increased heat transfer capacity of the second subset 116 of microchannel tubes 102 and corresponding fins coupled thereto therefore enables additional subcooling of the working fluid. In this way, the cooling capacity of the vapor compression system 30 may be increased, and more efficient operation of the vapor compression system 30 is enabled.

It will be appreciated that the working fluid may be more susceptible to pressure drop as the working fluid is directed through a flow path, such as the microchannels 156. Advantageously, the disclosed embodiments may also enable a reduction in pressure drop of the working fluid (e.g., subcooled working fluid) directed through the microchannel heat exchanger 100. More specifically, the second width 152 of the microchannel tubes 102 in the second subset 116 enables an increase in size of the flow path area of the microchannels 156 of each microchannel tube 102 in the second subset 116. For example, in the illustrated embodiment, each microchannel tube 102 in the second subset 116 includes more microchannels 156 as compared to each microchannel tube 102 in the first subset 114 of microchannel tubes 102. In additional or alternative embodiments, the increased size (e.g., the second width 152) of the microchannel tubes 102 in the second subset 116 may enable an increase in the size (e.g., diameter 170, cross-sectional area, etc.) of the microchannels 156 in the microchannel tubes 102 of the second subset 116. For example, the diameter 170 of one or more microchannels 156 in the microchannel tubes 102 of the second subset 116 may be greater than a diameter 172 of one or more microchannels 156 in the microchannel tubes 102 of the first subset 114. In this way, the cumulative flow path area of the microchannel tubes 102 of the second subset 116 may be increased, which enables a reduction in the velocity of the working fluid directed therethrough and thus a reduction in the pressure drop of the working fluid directed through the second subset 116 of microchannel tubes 102.

The disclosed techniques may be also implemented in embodiments of the microchannel heat exchanger 100 having different configurations. Indeed, the microchannel heat exchanger 100 may have different numbers of microchannel tubes 102, different numbers of subsets of microchannel tubes 102, different orientations of the microchannel tubes 102, different dimensions (e.g., widths, lateral dimensions, etc.) of the microchannel tubes 102 (e.g., within a common subset of the microchannel tubes 102), and so forth. For example, the first subset 114 and/or the second subset 116 of microchannel tubes 102 may include a first number of microchannel tubes 102 positioned in a first orientation (e.g., perpendicular relative to the longitudinal axis 160 of the first header 106) and a second number of microchannel tubes 102 positioned in a second orientation (e.g., at an oblique angle relative to the longitudinal axis 160 of the first header 106). In some embodiments, the subsets of microchannel tubes 102 may be grouped based on a pass of the microchannel heat exchanger 100 in which the microchannel tubes 102 are positioned and/or based on an orientation (e.g., relative to the longitudinal axis 160 of the headers 104) of the microchannel tubes 102 (e.g., perpendicular relative to the longitudinal axis 106 of the headers 104 and/or the direction 161 of the air flow, at an oblique angle relative to the longitudinal axis 160 of the headers 104 and/or the direction 161 of the air flow, etc.).

The spacing between each of the microchannel tubes 102 (e.g., along the longitudinal axis 160 of the first header 106) may also be varied and/or selected based on different operating parameters of the microchannel heat exchanger 100 and/or the vapor compression system 30. In some embodiments, the headers 104 may have different configurations. For example, in one embodiment, the first section 118 of the first header 106 may have a first size (e.g., first diameter 164 dimension), and the second section 120 of the first header 106 may have a second size (e.g., second diameter 164 dimension) different from the first size. Indeed, many variations of the configuration of the microchannel heat exchanger 100 may be utilized and may incorporate the preset techniques.

In any case, the orientation of at least a portion of the microchannel tubes 102 at the oblique angle 162 with the headers 104 enables improved heat transfer between the working fluid and the air flow directed across the microchannel heat exchanger 100, reduced pressure drop of the working fluid flowing through the microchannel heat exchanger 100, and improved operation of the vapor compression system 30. More specifically, certain microchannel tubes 102 may be larger (e.g., wider) than the other microchannel tubes 102 and may be secured to the headers 104 of the microchannel heat exchanger 100 at the oblique angle 162 in order to provide improved heat transfer and reduced working fluid pressure drop while also utilizing headers 104 having the diameter 164 at a smaller size.

While only certain features and embodiments of the present disclosure have been illustrated and described, many modifications and changes may occur to those skilled in the art (e.g., variations in sizes, dimensions, structures, shapes and proportions of the various elements, values of parameters (e.g., temperatures, pressures), mounting arrangements, use of materials, colors, orientations) without materially departing from the novel teachings and advantages of the subject matter recited in the claims. The order or sequence of any process or method steps may be varied or re-sequenced according to alternative embodiments. It is, therefore, to be noted that the appended claims are intended to cover all such modifications and changes as fall within the true spirit of the present disclosure. Furthermore, in an effort to provide a concise description of the exemplary embodiments, all features of an actual implementation may not have been described (i.e., those unrelated to the presently contemplated best mode of carrying out the present disclosure, or those unrelated to enabling the claimed embodiments). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heat exchanger for a heating, ventilating, and/or air conditioning (HVAC) system, comprising:

a header comprising a longitudinal axis;

a first plurality of microchannel tubes coupled to the header, wherein each microchannel tube of the first plurality of microchannel tubes comprises a first width; and a second plurality of microchannel tubes coupled to the header, wherein each microchannel tube of the second plurality of microchannel tubes comprises a second width greater than the first width, wherein the second width extends along a second axis, and the second axis extends at an oblique angle relative to the longitudinal axis.

2. The heat exchanger of claim 1, wherein the first width extends along a first axis extending through microchannels of the respective microchannel tube of the first plurality of microchannel tubes, and the second axis extends through microchannels of the respective microchannel tube of the second plurality of microchannel tubes.

3. The heat exchanger of claim 2, wherein each microchannel tube of the first plurality of microchannel tubes is coupled to the header such that the first axis of each microchannel tube extends generally perpendicularly to the longitudinal axis.

4. The heat exchanger of claim 1, wherein the oblique angle is 45 degrees or less.

5. The heat exchanger of claim 1, wherein the first plurality of microchannel tubes defines a first pass of the heat exchanger, and the second plurality of microchannel tubes defines a second pass of the heat exchanger.

6. The heat exchanger of claim 1, wherein the heat exchanger is a condenser, the first plurality of microchannel tubes is configured to condense a working fluid received via the header, and the second plurality of microchannel tubes is configured to subcool the working fluid and direct the working fluid into the header.

7. The heat exchanger of claim 1, wherein each microchannel tube of the first plurality of microchannel tubes comprises a first plurality of microchannels defining a first flow path, each microchannel tube of the second plurality of microchannel tubes comprises a second plurality of microchannels defining a second flow path, and a cross-sectional area of the second flow path is greater than a cross-sectional area of the first flow path.

8. The heat exchanger of claim 7, wherein a number of the second plurality of microchannels of each microchannel tube of the second plurality of microchannel tubes is greater than a number of the first plurality of microchannels of each microchannel tube of the first plurality of microchannel tubes.

9. The heat exchanger of claim 7, wherein a diameter of each microchannel of each microchannel tube of the second plurality of microchannel tubes is greater than a diameter of each microchannel of each microchannel tube of the first plurality of microchannel tubes.

10. A heat exchanger for a heating, ventilating, and/or air conditioning (HVAC) system, comprising:

a header comprising a longitudinal axis;

a first plurality of microchannel tubes coupled to the header and configured to direct a flow of working fluid therethrough, wherein each microchannel tube of the first plurality of microchannel tubes comprises a first width extending at a first angle relative to the longitudinal axis; and a second plurality of microchannel tubes coupled to the header and configured to direct the flow of working fluid therethrough, wherein each microchannel tube of the second plurality of microchannel tubes comprises a second width extending at a second angle relative to the longitudinal axis, wherein the first angle and the second angle are different from one another.

11. The heat exchanger of claim 10, wherein the second angle is an oblique angle.

12. The heat exchanger of claim 10, wherein the second width is greater than the first width.

13. The heat exchanger of claim 10, wherein a first microchannel tube of the first plurality of microchannel tubes comprises a first plurality of microchannels, a second microchannel tube of the second plurality of microchannel tubes comprises a second plurality of microchannels, and a first number of the first plurality of microchannels is less than a second number of the second plurality of microchannels.

14. The heat exchanger of claim 10, wherein a first microchannel tube of the first plurality of microchannel tubes comprises a first plurality of microchannels defining a first flow path, a second microchannel tube of the second plurality of microchannel tubes comprises a second plurality of microchannels defining a second flow path, and a first cross-sectional area of the first flow path is less than a second cross-sectional area of the second flow path.

15. The heat exchanger of claim 10, wherein the second plurality of microchannel tubes is downstream from the first plurality of microchannel tubes relative to a direction of the flow of working fluid through the heat exchanger.

16. A heat exchanger for a heating, ventilating, and/or air conditioning (HVAC) system, comprising:

a header comprising a longitudinal axis;

a first plurality of microchannel tubes coupled to the header and configured to direct a flow of working fluid therethrough, wherein each microchannel tube of the first plurality of microchannel tubes comprises a first width extending at a first angle relative to the longitudinal axis; and a second plurality of microchannel tubes coupled to the header and configured to direct the flow of working fluid therethrough, wherein each microchannel tube of the second plurality of microchannel tubes comprises a second width extending at a second angle relative to the longitudinal axis, wherein the second width is greater than the first width, and the first angle and the second angle are different from one another.

17. The heat exchanger of claim 16, wherein the first angle is approximately ninety degrees, and the second angle is an oblique angle.

18. The heat exchanger of claim 16, wherein the first plurality of microchannel tubes defines a first pass of the heat exchanger, and the second plurality of microchannel tubes defines a second pass of the heat exchanger.

19. The heat exchanger of claim 16, wherein a first microchannel tube of the first plurality of microchannel tubes comprises a first plurality of microchannels defining a first flow path, and a second microchannel tube of the second plurality of microchannel tubes comprises a second plurality of microchannels defining a second flow path, and wherein a first number of the first plurality of microchannels is less than a second number of the second plurality of microchannels, a first cross-sectional area of the first flow path is less than a second cross-sectional area of the second flow path, or both.

* * * * *